US005473879A

United States Patent [19]

Gobbels et al.

[11] Patent Number: 5,473,879

[45] Date of Patent: Dec. 12, 1995

[54] OPEN-END SPINNING MACHINE FOR PRODUCING CROSS-WOUND BOBBINS

[75] Inventors: Heinz-Dieter Gobbels; Hans Raasch, both of Monchengladbach, Germany

[73] Assignee: W. Schlafhorst AG & Co., Moenchengladbach, Germany

[21] Appl. No.: 232,829

[22] Filed: Apr. 22, 1994

[30] Foreign Application Priority Data

Apr. 24, 1993 [DE] Germany ..... 43 13 523.4

[51] Int. Cl.[6] ..... D01H 13/26; D01H 9/10

[52] U.S. Cl. ..... 57/263; 57/261; 57/269

[58] Field of Search ..... 57/263, 261, 269, 57/264, 278, 22

[56] References Cited

FOREIGN PATENT DOCUMENTS

| | | |
|---|---|---|
| 0106809B | 9/1986 | European Pat. Off. . |
| 0203508B | 7/1990 | European Pat. Off. . |
| 0311987B | 11/1991 | European Pat. Off. . |
| 2501735A1 | 7/1976 | Germany . |
| 3209814A1 | 9/1982 | Germany . |
| 3123494C2 | 1/1983 | Germany . |
| 3801965A1 | 7/1989 | Germany . |
| 3801964A1 | 7/1989 | Germany . |
| 3932666A1 | 9/1990 | Germany . |
| 4231730A1 | 4/1993 | Germany . |

*Primary Examiner*—William Stryjewski
*Attorney, Agent, or Firm*—Shefte, Pinckney & Sawyer

[57] ABSTRACT

An open-end spinning machine embodied as a yarn piecing unit for automatically repairing yarn breaks during bobbin winding and for replacing finished bobbins with empty tubes, and an auxiliary yarn transport arrangement for supplying and removing an auxiliary yarn used for the piecing operation. The auxiliary yarn transport arrangement has a yarn supply tube that can be positioned among various operating positions: (a) a first position wherein the auxiliary yarn is transferred to a yarn locating nozzle of the piecing unit; (b) a second operating position wherein the piecing cycle is initiated by spinning an end of the auxiliary yarn with individual fibers fed into the spinning rotor of the spinning machine; and (c) a third operating position wherein the auxiliary yarn and its pieced end is severed from the trailing length of newly spun yarn from the spinning rotor and the new yarn is applied to an empty tube in the winding creel of the spinning machine.

12 Claims, 5 Drawing Sheets

OPEN-END SPINNING MACHINE FOR PRODUCING CROSS-WOUND BOBBINS

BACKGROUND OF THE INVENTION

The present invention relates to an open-end spinning machine for producing cross-wound bobbins, sometimes referred to as cheeses, wherein the spinning machine is provided with a servicing apparatus equipped for automatic repair of yarn breaks during bobbin winding and for exchanging finished bobbins with empty yarn-winding tubes by utilizing an apparatus for furnishing and removing an auxiliary yarn used for piecing-up the yarn being wound to the replacement tube.

Yarn piecing units operable upon the occurrence of a yarn break to first clean the spinning element and then re-piece the broken yarn using a yarn end taken by suction from the bobbin held in the creel of the spinning station, are known. These piecing units cooperate with special bobbin changing carriages, which assure that finished bobbins will be replaced with empty starter tubes. The starter tubes are transferred from the changing carriage to the creel of the spinning station in a form already containing a certain quantity of yarn which the piecing unit needs for the piecing-up operation.

Service units are also known which can not only repair "normal" yarn breaks but are also equipped to carry out bobbin changing operations utilizing an auxiliary piecing yarn which is inserted and removed to perform a piecing-up operation, such as representatively disclosed in German Patent DE 38 01 965 A, and European Patents EP 0 106 809 B, EP 0 203 508 B, or EP 0 311 987 B.

The piecing unit disclosed in European Patent EP 0 106 806 B, for instance, has an auxiliary yarn transport apparatus with numerous, successively triggered auxiliary yarn transfer elements. The auxiliary yarn drawn from a supply bobbin is first engaged by a yarn clamp disposed on the end of a pivoting lever and then fed by it into the region of a suction nozzle. The suction nozzle transfers the auxiliary piecing yarn to the spinning box of the spinning station. During the transfer of the auxiliary yarn by the pivoting lever, the yarn end is moved past a further suction nozzle, which accordingly aspirates a loop of yarn. This second suction nozzle is pivotable into the region of the bobbin winding mechanism to apply the pieced-up yarn to an empty tube held in the winder creel.

The piecing unit of European Patent EP 0 203 508 B is equipped with an auxiliary yarn transport apparatus having not only two separate suction nozzles but also two individually triggerable yarn clamps. In this arrangement, the auxiliary yarn, which is drawn from the supply bobbin by a yarn delivery mechanism, is engaged at the outlet of the delivery mechanism by a suction nozzle and moved to the region of the bobbin winder, forming a length of the piecing yarn. Next, the auxiliary yarn is positioned by a centering means and aspirated by the yarn locating suction nozzle of the piecing unit. The end of the auxiliary yarn is brought to the region of the spinning box by the first yarn clamping device. Since the first suction nozzle exerts suction continuously, the auxiliary yarn end must be secured by a second yarn clamp during the return of the auxiliary yarn to the spinning rotor since otherwise the yarn end would be aspirated into the first suction nozzle.

European Patent EP 0 311 987 B describes an apparatus with a pneumatic-mechanical auxiliary yarn transport arrangement. An auxiliary yarn drawn from a supply bobbin is first presented by a pneumatic yarn transport device to a mechanical delivery device, which delivers the yarn into the region of the winding mechanism and transfers it to a special suction nozzle of a yarn piecing carriage. Yarn payout after piecing-up then takes place via the mechanical yarn delivery device.

The arrangements described above have various disadvantages. For instance, they are relatively complicated in design and have the risk that the yarn may be lost during the frequent transfers which take place.

SUMMARY OF THE INVENTION

Based on the aforementioned state of the art, it is an object of the present invention to provide a service apparatus for an open-end spinning machine capable of reliable functioning and economical design, and which can not only automatically repair normal yarn breaks but also replace completed bobbins with empty tubes.

Thus, the present invention provides an improved servicing apparatus for use in conjunction with an open-end spinning machine producing cross-wound bobbins for automatically repairing yarn breaks occurring during the winding operation and exchanging empty yarn-winding tubes for finished bobbins. Basically, the servicing apparatus of the present invention provides means for supplying and removing an auxiliary yarn for use in piecing-up the yarn being wound when repairing a yarn break or performing an exchange operation. The auxiliary yarn means comprises an auxiliary yarn transport arrangement having a yarn supply tube that is positionable in multiple operating positions, a compressed air connection and a suction air connection to the auxiliary yarn transport arrangement, and means associated with the compressed air and suction connections for applying a pneumatic force through the yarn supply tube on the auxiliary yarn continuously between an auxiliary yarn supply location and an auxiliary yarn transfer location in each of the plural operating positions of the supply tube.

The present invention has the advantage of a simple design, since the auxiliary yarn is guided in a manipulator continuously during the entire bobbin changing and yarn piecing cycle. Both the supply of the auxiliary yarn and its withdrawal are accomplished via the auxiliary yarn transport arrangement which is preferably embodied with a pivotable supply tube. To that end, the service arrangement can be connected in defined fashion either to a compressed-air connection or a suction connection. The auxiliary yarn transport apparatus is designed to be very easy to understand, and is moreover very easy to repair and maintain because of its good accessibility.

The first working position of the supply tube, in which the transfer of the auxiliary yarn end to a yarn locating nozzle of the service apparatus takes place, is located outside the operating region of the other yarn manipulating elements disposed on the service arrangement so as to be readily accessible.

According to one advantageous feature of the invention, after the transfer of the end of the auxiliary yarn to the yarn locating nozzle, the supply tube which is acted upon by compressed air is pivotable to a second working position which is spaced from the yarn locating nozzle. In this manner, a length of auxiliary yarn is created between the yarn locating nozzle and the mouth of the supply tube which can easily be grasped by the piecing devices of the service arrangement. In the second working position, the supply tube of the auxiliary yarn transport arrangement is preferably located at the highest point of the pivoting path of travel of the supply tube during the piecing cycle as determined by a parallelogram arrangement of tube supporting arms.

During the piecing cycle, the auxiliary yarn transport arrangement is preferably switched from its compressed air connection to its suction connection, so that the auxiliary yarn remains taut while traveling between gripping tongs of a yarn delivery arm and the mouth of the supply tube. The end of the auxiliary yarn is placed into the spinning box to be applied to a circumferential ring of fibers formed of individual fibers fed into and revolving in the spinning rotor to resume the open-end spinning operation and the resultant yarn is drawn off via a yarn withdrawal device of the service arrangement and removed via the auxiliary yarn transport arrangement.

A sensor device is disposed in the region of the supply tube to monitor the entering auxiliary yarn and upon recognition of the area at which the end of the auxiliary yarn is pieced to the newly spun yarn trailing therefrom the sensor initiates pivoting of the supply tube to a third position.

The yarn produced in the spinning box is then placed against the empty tube which is rotatably held in tube support plates between the arms of a creel and surface driven by a winding drum of the bobbin winding mechanism. Next, the yarn is severed by a yarn cutter disposed in the region of the supply tube, and the pieced yarn area and the preceding length of auxiliary yarn are thus cut from the trailing newly-spun section of yarn.

According to an advantageous feature of the invention, one of the tube plates of the winder creel has a yarn catching device that grasps the yarn produced in the spinning box.

In accordance with a further feature of the invention, a yarn guide element disposed in the region of the supply tube has a yarn baffle that can be pivoted inwardly to assure that the yarn is taut in a predetermined position across both the tube and the tube plate. Once the yarn baffle has been pivoted inwardly, it is assured that the yarn catching device of the tube plate will reliably grasp the yarn.

DESCRIPTION OF THE PREFERRED EMBODIMENT

Figure 1:
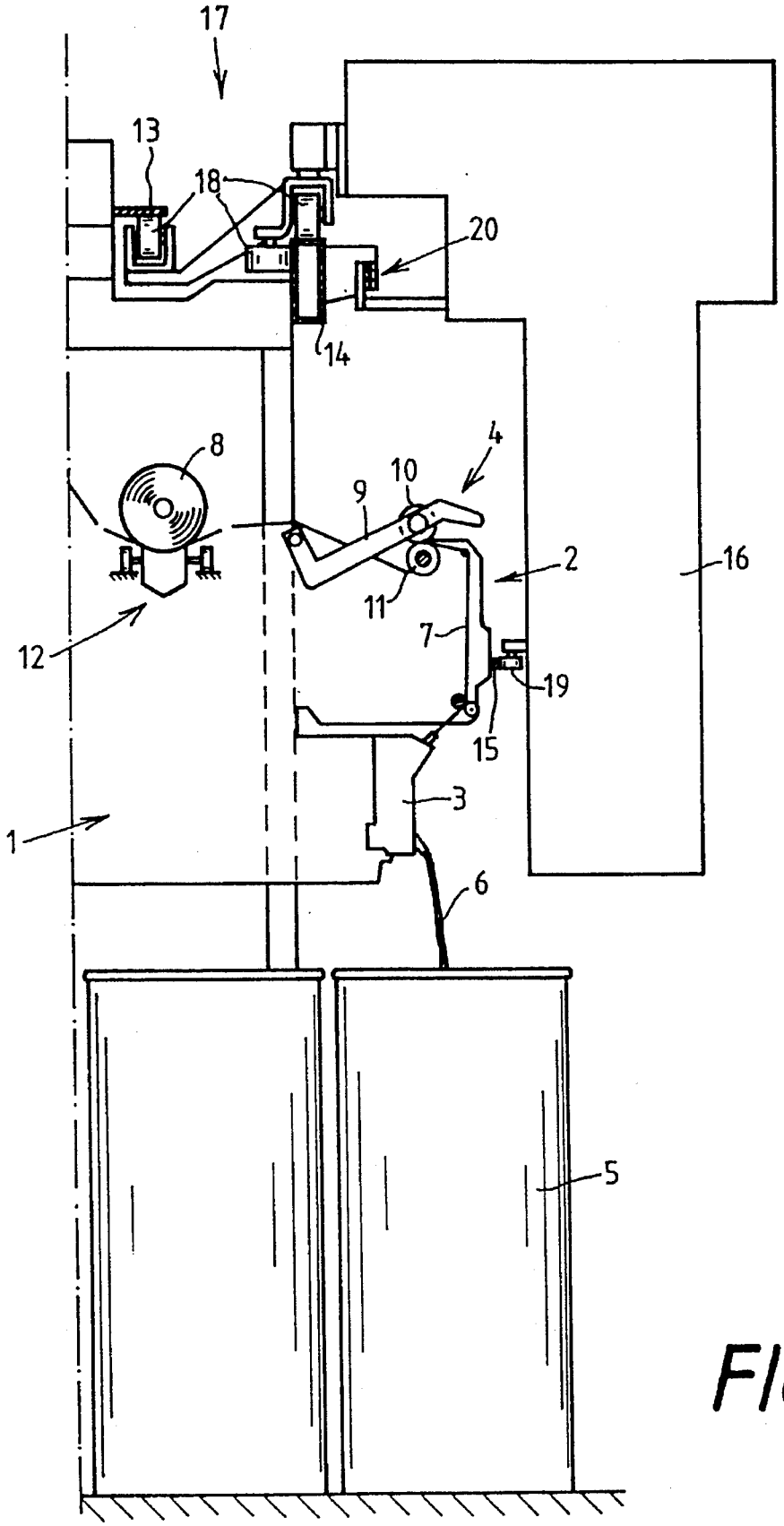
FIG. 1 is an end elevation of one side of an open-end spinning machine with a service arrangement having an auxiliary yarn transport arrangement according to a preferred embodiment of the present invention.

FIG. 1 shows one side of an open-end spinning machine, indicated broadly at 1, which is of the general type known in the art. Each side of such spinning machines has a plurality of spinning stations 2, each equipped with both a yarn spinning box 3 and a bobbin winder 4. In each spinning box 3, a sliver 6 supplied from sliver cans 5 is spun into a yarn 7 by means of an open-end spinning rotor (not shown) and the yarn is progressively withdrawn and wound by the bobbin winder 4 onto the tube 10 to make a cross-wound bobbin, or cheese, 8. As shown, each bobbin winder 4 is equipped with a creel 9 for rotatably retaining the tube 10 or the bobbin 8 in peripherally driven contact with a winding drum 11.

The open-end spinning machine 1 also has a revolving tube and bobbin transport conveyor arrangement 12 for supplying empty tubes to and removing completed bobbins from the spinning stations of the machine.

A service apparatus, preferably in the form of a yarn piecing unit 16, is mounted on the spinning machine 1 for traveling movement on guide rails 13,14 and a support rail 15 extending along the length of the machine. An undercarriage 17 of this piecing unit 16 has rollers 18 and a support wheel 19 for supported engagement with the rails 13,14,15. Electrical energy is supplied to the piecing unit 16 via a wiper contact device 20, as indicated. However, the use of a trailing chain arrangement is also contemplated.

The yarn piecing unit 16 travels continuously along the open-end spinning machine 1 and automatically intervenes whenever a need exists for appropriate yarn manipulation at one of the spinning stations 2, e.g., if a yarn break has occurred at a station 2, or if a bobbin at one of the stations has reached its prescribed completed diameter and must be replaced with an empty tube.

In such a case, the piecing unit 16 travels to and positions itself at the applicable spinning station. In the case of an ordinary yarn break, the piecing unit 16 activates a yarn locating suction nozzle 21 for the broken end of the yarn resting on the circumferential periphery of the bobbin 8. After cleaning of the spinning box, the located yarn end is reinserted in the spinning box into disposition at a fiber ring revolving therein for resumption of the spinning operation.

The servicing process is somewhat more difficult if a full bobbin is first to be replaced with an empty tube and then the yarn piecing operation is to be performed.

Figure 2:
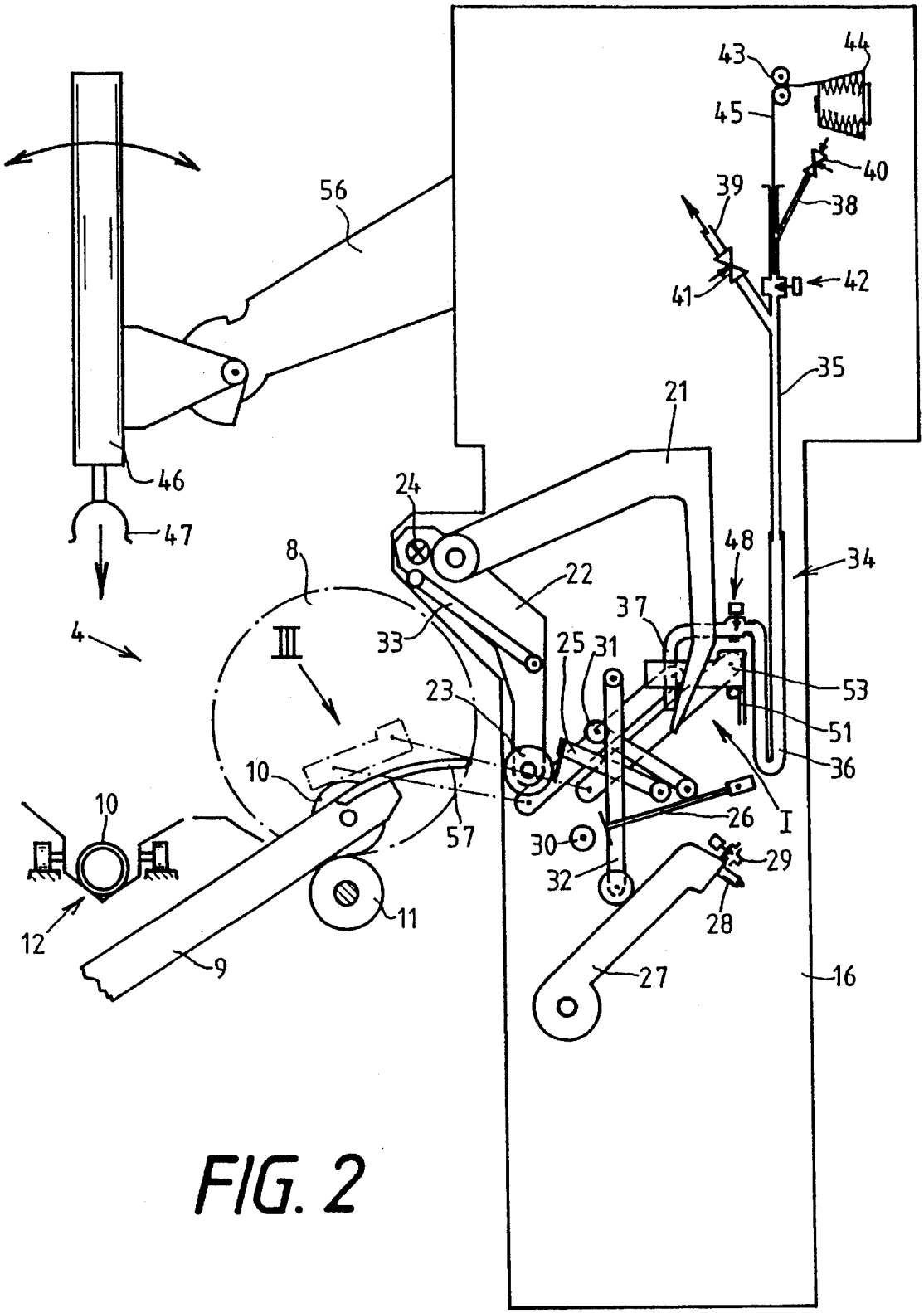
FIG. 2 is a schematic end view of the service arrangement of FIG. 1 depicting its essential control elements.
Figure 7:
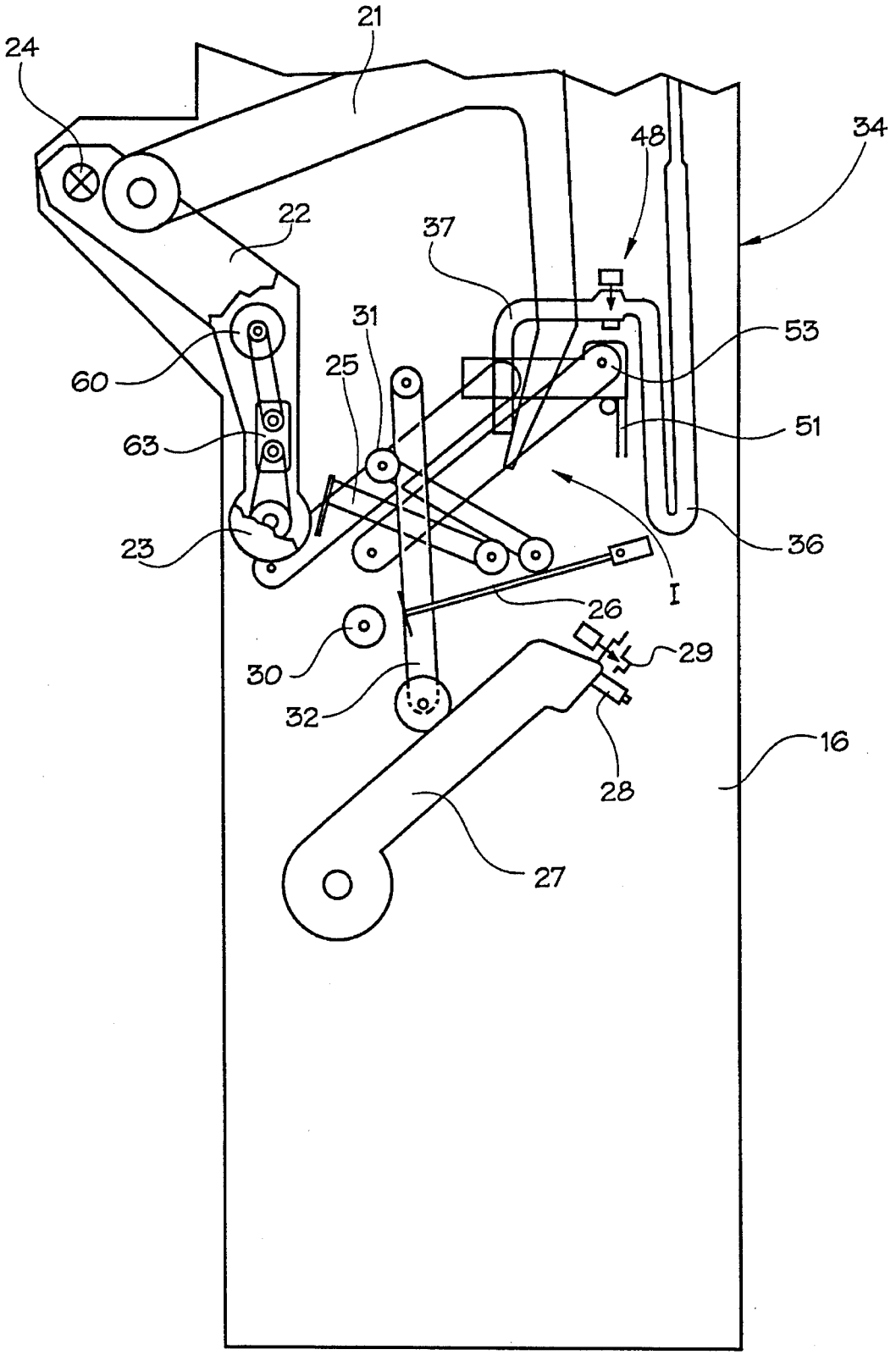
FIG. 7 is a schematic end view of the lower part of the service arrangement of FIG. 2 depicting its essential control elements.

FIG. 2 schematically shows the piecing unit 16 with all of the basic operating components and elements which are essential and necessary for carrying out these servicing operations. The piecing unit 16 has a pivotable yarn locating nozzle 21 having a suction slot which can be placed against the peripheral circumference of the bobbin 8 for aspirating and receiving broken yarn ends. A bobbin ejection arm 22 is pivoted to the piecing unit 16 and has a drive roller 23 disposed on its end for driven rotation by a drive motor 60, shown in FIG. 7, in conjunction with an electric clutch 63, also shown in FIG. 7, for selective disconnection of the roller 23. An angle encoder 24 is disposed on the driving arm 22 to enable monitoring of the position of the driving arm at any time.

In a known manner, the piecing unit 16 is also equipped with a yarn catching baffle 25, a yarn inserter 26, a yarn delivery arm 27 with gripping tongs 28, a yarn cutter 29 and a controllable yarn draw-off device. The yarn draw-off device comprises a draw-off roller 30 and a pressure roller 31 that is supported for movement toward and away from the draw-off roller 30 by a pivoting arm.

As further control elements, a frame opener 32, a pressure lever 33 and an auxiliary yarn transport arrangement 34 are incorporated into the piecing unit 16. The auxiliary yarn transporting arrangement 34 essentially comprises a tube system 35, which communicates via a flexible connecting element 36, such as a hose-like conduit, with a supply tube 37 that can be pivoted into various operating positions. The supply tube 37 is secured to a supply tube retainer 53, which can be moved along an arcuate path S (FIG. 4) via a pivoting parallelogram arm assembly. An auxiliary yarn 45 is fed from a supply bobbin 44 via a yarn delivery mechanism 43, e.g., a pair of driven rollers as shown in FIG. 2, and is drawn into the tube system 35. The tube system 35 has a compressed air connection 38 equipped with an injector nozzle and a suction air connection 39. The air connections 38,39 can each be attached or connected to the tube system 35 in a defined manner via respective valves 40,41. In this manner, either pressurized air or suction may be applied through the length of the tube system 35. A yarn cutter 42 is also disposed within the tube system 35.

The piecing unit 16 also has a tube gripper 46 disposed on a bracket 56 above the undercarriage 17, the tube gripper 46 having gripper elements 47 which conform to the outside diameter of the empty tubes 10 for gripping engagement thereof as they are advanced along the spinning stations 2 via the bobbin and tube transport arrangement 12.

Operation of the apparatus of the present invention may thus be understood. When intervention of the piecing unit 16 is required at a spinning station, e.g., to repair a yarn break or replace a completed bobbin with an empty tube, the piecing unit 16 either detects the occurrence or is informed thereof via the data transmission system of the open-end spinning machine and the piecing unit 16 travels to and positions itself at that spinning station 2. Through appropriate sensing or detecting means, the piecing unit 16 either ascertains for itself what flaw or error is involved at the spinning station 2, i.e., an ordinary yarn break or a bobbin requiring change, or the piecing unit 16 is informed of the condition of the station via the data transmission system of the open-end spinning machine.

Depending on the situation involved, a control unit for the piecing unit 16 initiates the corresponding operational programs for controlling the operational components of the piecing unit 16 to control the various operations required. For instance, if a bobbin 8 has reached its maximum diameter and must be replaced with an empty tube 10, then the following program steps must take place. First, the tube gripper 46, which for instance may be embodied as a telescoping extension arm, pivots into the upright position shown in FIG. 2 and advances the gripper element 47 outward in the downward direction of the tube and bobbin transport arrangement 12. The gripper element 47 disposed on the outward end of the gripper 46 slides over an empty tube 10 located in the tube and bobbin transport arrangement 12, and, as the tube gripper 46 is then retracted into an upper position, the empty tube 10 is raised along with it. Next, the frame opener 32 pivots into engagement with a guide attachment 57 disposed on the arm of the creel 9 to press the arm of the creel 9 outwardly so that the bobbin 8 is released and can be transferred to the tube and bobbin transport arrangement 12 by forward pivoting action of the bobbin ejection arm 22 of the piecing unit 16. The drive roller 23 disposed on the end of the displacement arm 22 is decoupled from its drive during this action in order to avoid damage to the yarn surface of the bobbin.

The pressure lever 33 is also moved into engagement with the guide attachment 57 of the creel and the frame opener 32 and the pressure lever 33 then pivot the creel 9 upwardly into an empty tube transfer position located at a predetermined distance above the winding drum 11. In this predetermined position, the gripper element 47 transfers the previously-retained empty tube 10 to the creel 9. The proper transfer of the empty tube 10 is monitored by the angle encoder 24 disposed on the bobbin ejection arm 22, which detects a missing or incorrectly placed empty tube 10 as an error based upon any deviation in the angular position of the ejection arm 22 from a predetermined command value.

A yarn piecing cycle is also started simultaneously with the above-described tube changing operation. In the piecing cycle, an auxiliary yarn 45 stored on the supply bobbin 44 in the piecing unit 16 is first drawn from the supply bobbin 44 by the yarn delivery mechanism 43 and advanced inside the auxiliary yarn transport arrangement 34 to the mouth of the supply tube 37. The auxiliary yarn 45 is transported pneumatically continuously through the entire length of the tube system 35 of the auxiliary yarn transport arrangement 34, for instance by means of the aforementioned injector nozzle disposed in the compressed air connection 38.

Figure 3:
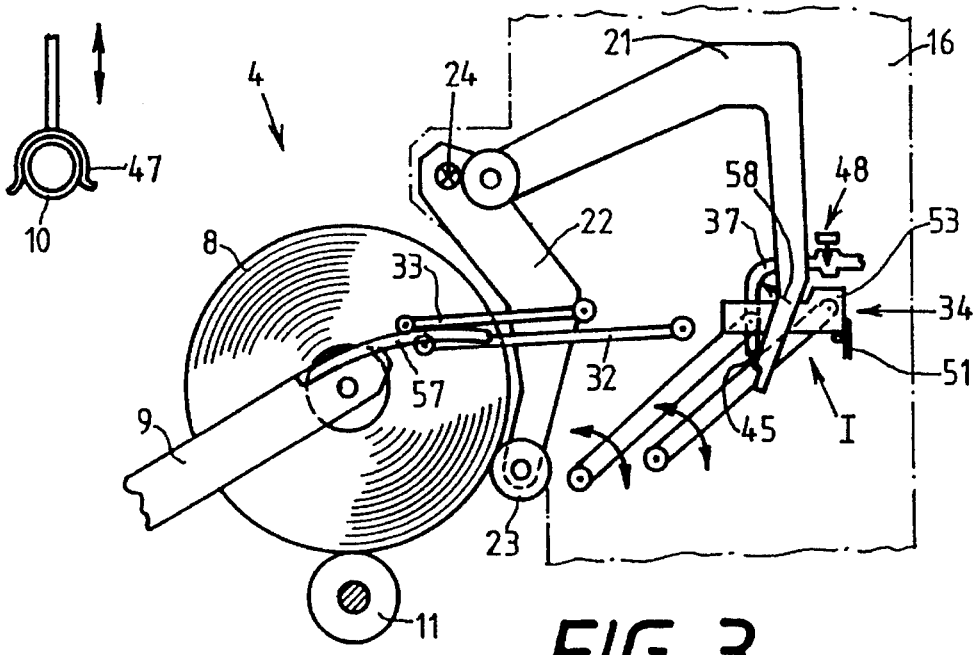
FIG. 3 is a schematic end view of the service arrangement, similar to FIG. 2, showing the supply tube of the auxiliary yarn transport arrangement in a first working position.

Initially, the supply tube 37 is in its rear working position I, indicated in FIGS. 2 and 3, in which the outlet mouth of the supply tube 37 is in the immediate vicinity of the intake slot of the yarn locating nozzle 21 of the piecing unit 16. At such time, the yarn locating nozzle 21 is in a parked position in which it does not interfere with other operating elements disposed in the piecing unit 16. The end of the auxiliary yarn 45 extending through the auxiliary yarn transport arrangement 34 emerges from the mouth of the supply tube 37 and immediately enters the operative suctioning range of the yarn locating nozzle 21 which aspirates the yarn end.

Figure 4:
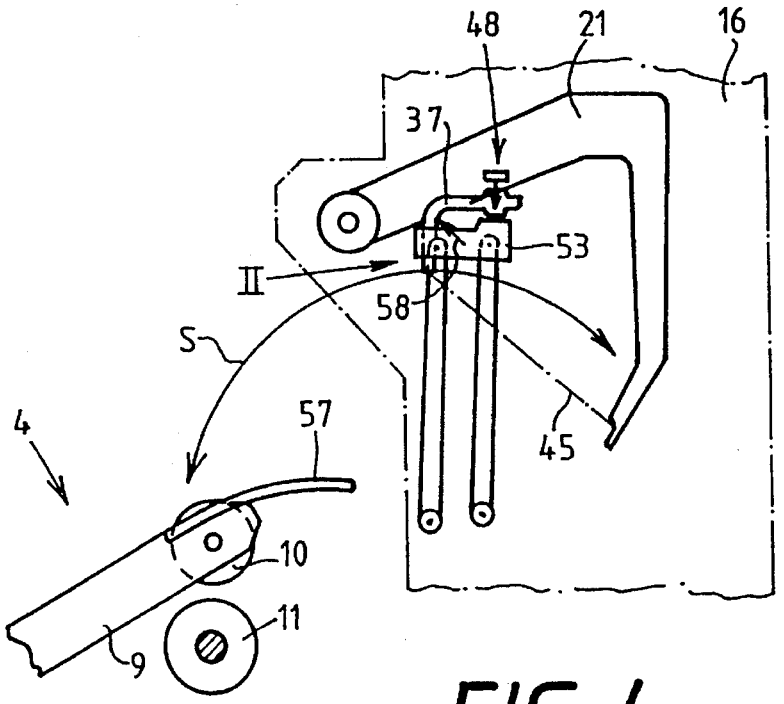
FIG. 4 is another schematic end view of the service arrangement, similar to FIGS. 2 and 3, showing the supply tube of the auxiliary yarn transport arrangement in a second working position.

Next, the supply tube 37 is pivoted by its supporting parallelogram arm assembly forwardly toward the spinning machine into a second working position, indicated at II in FIG. 4, wherein the outlet mouth of the supply tube 37 is located at an upper position in the arcuate path S of movement of the supply tube 37. During the pivoting movement, precisely as much auxiliary yarn 45 as is needed in order to maintain a taut length of the auxiliary yarn 45 between the mouth of the supply tube 37 and the yarn locating nozzle 21 is supplied by the auxiliary yarn transport arrangement 34.

The length of the auxiliary yarn 45 that is held taut between the mouth of the supply tube 37 and the yarn locating nozzle 21 is now utilized for piecing-up by the yarn piecing components of the piecing unit 16. Initially, while the end of the auxiliary yarn 45 remains held by suction in the locating nozzle 21, an intermediate section of the yarn 45 is positioned by the yarn catching baffle 25 and transferred by the yarn inserter 26 to the yarn delivery arm 27. Next, while the auxiliary yarn 45 is held between the gripping tongs 28 on the yarn delivery arm 27, the yarn is severed by the yarn cutter 29 and the severed yarn end is removed by suction through the yarn locating nozzle 21. The auxiliary yarn transport arrangement 34 is switched over to suction operation through the suction connection 39, and the auxiliary yarn 45 is cut inside the tube system 35 by the yarn cutter 42. The end of the auxiliary yarn 45 that is caught between the gripping tongs 28 of the yarn deliver yarn 27 is prepared by untwisting the constituent fibers sufficiently to open the yarn end, and the yarn is transferred to the spinning box 3 by the forward pivoting of the delivery arm 27 and placed in the spinning rotor against the ring of individual fibers formed therein.

The auxiliary yarn 45 with a trailing length of newly spun yarn is drawn from the spinning rotor via the yarn draw-off device 30,31 and aspirated into the supply tube 37. A yarn cutter 48 and a sensor device 58 are disposed adjacent the end region of the supply tube 37. The sensor device 58 detects the pieced region of the yarn between the auxiliary yarn 45 and the new yarn 7 as it enters the supply tube 37 and thereupon initiates the yarn cutter 48, which cuts the pieced yarn area out along with the auxiliary yarn by severing the new yarn 7 at a location downstream of the pieced region.

Figure 6:
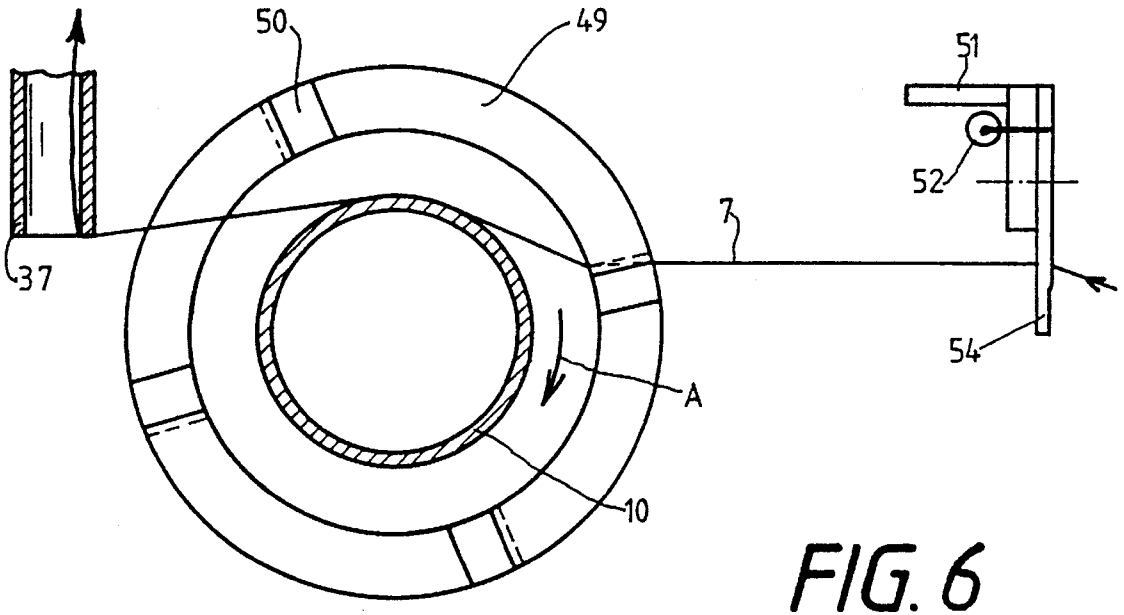
FIG. 6 is a view of the auxiliary yarn transport arrangement of FIG. 5 as seen in the direction of arrow X.
Figure 5:
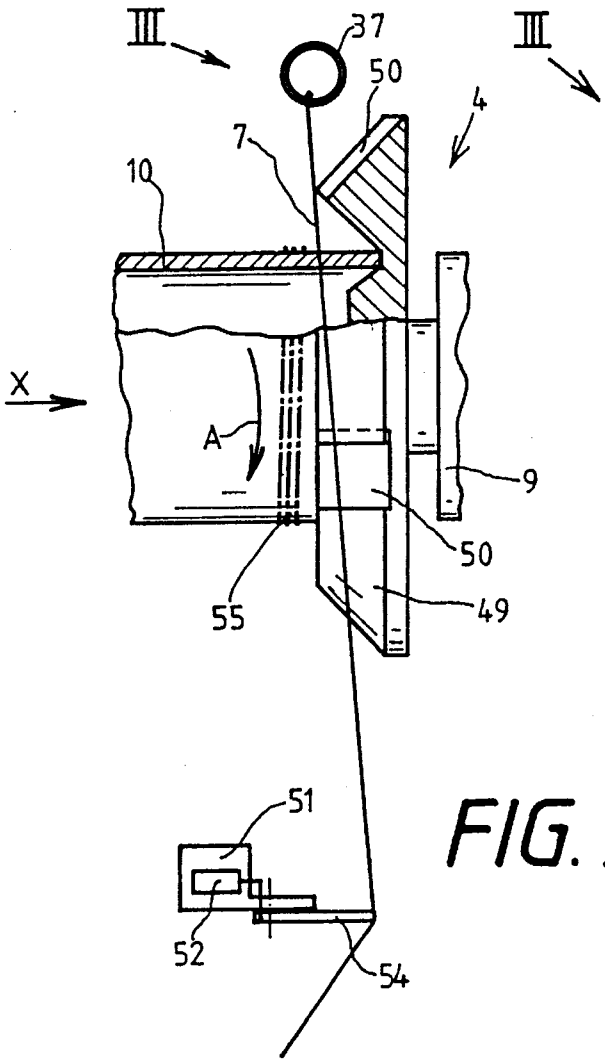
FIG. 5 is a side view of the service arrangement showing the auxiliary yarn transport arrangement when the yarn is applied to an empty tube.

As shown in FIGS. 5 and 6, the supply tube 37 is next pivoted into a third working position III (also shown in broken lines in FIG. 2) to place the yarn 7 against the empty tube 10. The empty tube 10 is retained between the tube support plates 49 of the creel 9 and revolves in the direction A as a result of having been lowered into peripheral contact with the winding drum 11 of the bobbin winder 4.

One of the revolving tube plates 49 has a yarn catching device 50 which, by way of example, may comprise one or more dovetail-like undercut entrainment grooves at the edge of the plate. A yarn guide element 51 disposed on the supply tube retainer 53 carries the yarn extending from the mouth of the supply tube 37 across the tube plate 49 so as to be engaged by the revolving entrainment grooves 50 disposed on the tube plate.

The yarn guide element 51 moreover has an adjustable yarn baffle 54, which is acted upon via a pneumatic drive 52 to enable a defined guidance of the yarn 7 on the empty tube 10. By movement of the yarn baffle 54 inward from the adjacent tube plate 49, a defined guidance of the yarn 7 on the empty tube 10. By movement of the yarn baffle 54 inward from the adjacent tube plate 50, initial winding 55 of the yarn is formed on the empty tube 10, and the tube exchange yarn piecing cycle is thus ended. The operation of exchanging a completed bobbin for an empty tube is thus concluded and the auxiliary yarn transport arrangement 34 and the supply tube 37 return rearwardly to the original working position I. The service apparatus 16 is then ready to travel to another spinning station to perform another servicing operation.

In an alternative embodiment, it is contemplated that, once the auxiliary yarn 45 has been delivered through the auxiliary yarn transport arrangement 34 to the mouth of the supply tube 37 positioned at the start of a yarn piecing operation in its rear working position I and the auxiliary yarn 45 has been aspirated by the yarn locating nozzle 21, the yarn supply tube 37 may be pivoted by its supporting parallelogram arm assembly forwardly beyond the second working position II and into the third working position III. As in the embodiment described above, the auxiliary yarn 45 is drawn outwardly of the supply tube 37 during this pivoting movement and is thereby exposed for grasping and manipulation by the various yarn joining elements of the piecing unit 16. Thus, in this embodiment, the second and third working position II and III coincide with one another.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A servicing apparatus for use in an open-end spinning machine for automatic repairing of yarn breaks during winding operations and for exchanging empty yarn-winding tubes for finished bobbins, comprising:

an auxiliary yarn transport arrangement having two ends for transporting auxiliary yarn therebetween for use in piecing-up a yarn being wound and for subsequently removing and disposing of auxiliary yarn after completion of the piecing-up operation, the auxiliary yarn transport arrangement having a yarn supply tube at one end thereof that is movable between plural operating positions, and a compressed air connection and a suction connection located at the other end of the auxiliary yarn transport arrangement, and means for applying a pneumatic yarn controlling force selectively through the compressed air and suction connections for continuous pneumatic control of the movement of auxiliary yarn throughout the transport arrangement when the supply tube is in one of the plural operating positions.

2. The apparatus of claim 1, wherein the servicing apparatus further comprises a yarn-locating suction nozzle and, in a first operating position of the supply tube, an outlet of the supply tube is disposed at the yarn-locating suction nozzle while located in a parked position thereof.

3. The apparatus of claim 2, wherein the supply tube is positionable in a second operating position spaced from the yarn-locating nozzle to cause a length of the auxiliary yarn to extend taut between the outlet of the supply tube and the yarn locating nozzle for engagement by yarn manipulating elements of the servicing apparatus.

4. The apparatus of claim 3, wherein the supply tube is pivotable and that the second operating position thereof is located at an intermediate region of its range of pivoting movement.

5. The apparatus of claim 3, wherein the supply tube is positionable in a third operating position wherein the outlet of the supply tube is located adjacent a bobbin winding location of the spinning machine.

6. The apparatus of claim 5, wherein the second and third operating positions of the supply tube coincide.

7. The apparatus of claim 5, wherein the supply tube in the third operating position orients the yarn in the supply tube in a disposition to be grasped by yarn engagement elements disposed on a tube support element of a yarn winding means of the spinning machine.

8. The apparatus of claim 1, wherein the auxiliary yarn transport arrangement further comprises tubular pneumatic conduit means including a flexible connecting conduit communicating with the supply tube and a yarn cutter associated with the conduit means.

9. The apparatus of claim 1, and further comprising movable yarn manipulating means disposed adjacent the supply tube.

10. The apparatus of claim 1, and further comprising a yarn cutter located in the region of the supply tube.

11. The apparatus of claim 1, wherein the servicing apparatus has means for exchanging a completed yarn bobbin with an empty tube comprising means for opening a yarn winding means of the spinning machine and means for ejecting a bobbin therefrom, the ejecting means including a movable arm, a driven roller disposed on the arm, a drive for the roller, and a shiftable clutch connecting the roller to its drive.

12. The apparatus of claim 11, wherein an angle encoder is disposed on the ejecting means to monitor movement of its arm.

* * * * *